United States Patent [19]

Nakagawa

[11] Patent Number: 4,663,869

[45] Date of Patent: May 12, 1987

[54] DISPLAY FOR DISPLAYING IMAGES IN THREE DIMENSIONS

[75] Inventor: Shigeru Nakagawa, Fujisawa, Japan

[73] Assignee: Marui Industry Co., Ltd., Tokyo, Japan

[21] Appl. No.: 747,374

[22] Filed: Jun. 21, 1985

Related U.S. Application Data

[63] Continuation-in-part of Ser. No. 660,423, Oct. 10, 1984, abandoned.

[51] Int. Cl.[4] ..... G09F 13/12

[52] U.S. Cl. ..... 40/219

[58] Field of Search ..... 40/219, 900; 350/600, 350/601, 642; 427/162; 272/8 M

[56] References Cited

U.S. PATENT DOCUMENTS

| | | | |
|---|---|---|---|
| 2,069,368 | 2/1937 | Horinstein | 40/219 |
| 2,114,711 | 4/1938 | Horinstein | 40/219 |
| 2,221,880 | 11/1940 | White | 40/219 |
| 2,221,887 | 11/1940 | White | 40/219 |
| 4,417,411 | 11/1983 | Miyagishima et al. | 40/443 |

FOREIGN PATENT DOCUMENTS

| | | | |
|---|---|---|---|
| 500566 | 6/1930 | Fed. Rep. of Germany | 40/219 |

*Primary Examiner*—Gene Mancene
*Assistant Examiner*—Cary E. Stone
*Attorney, Agent, or Firm*—Wenderoth, Lind & Ponack

[57] ABSTRACT

The three dimensional display of the invention includes a display plate and a light source provided behind the plate. The display plate fundamentally includes a substrate made of a transparent material, an undercoating of transparent organic based color or colorless paint provided on the front surface of the plate, a light-reflective transparent metal coating on the undercoating, a transparent protective coating on the metal coating and a light-reflective surface provided on the rear surface of the substrate, the light reflective surface being opaque as a whole and including light-penetrable or transparent portions or vacant portions in the form of a predetermined image. To make the front surface of the display plate look like a roughened metal wall surface, the front surface of the substrate is roughened or the undercoating contains an agent which makes the front surface of the undercoating rough. To make the front surface of the display plate look like a blurred metal wall surface, the protective coating contains a deglazing agent.

18 Claims, 8 Drawing Figures

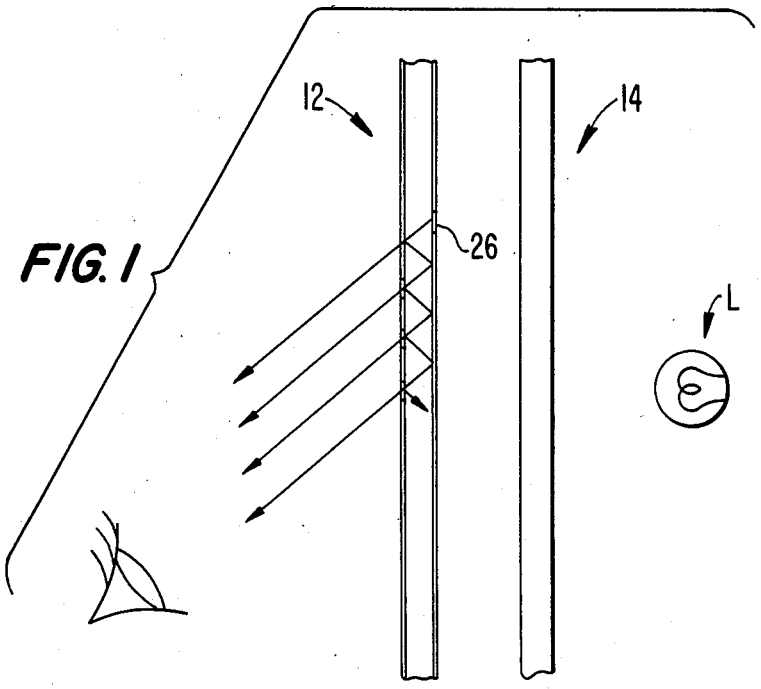
FIG. 1
FIG. 3
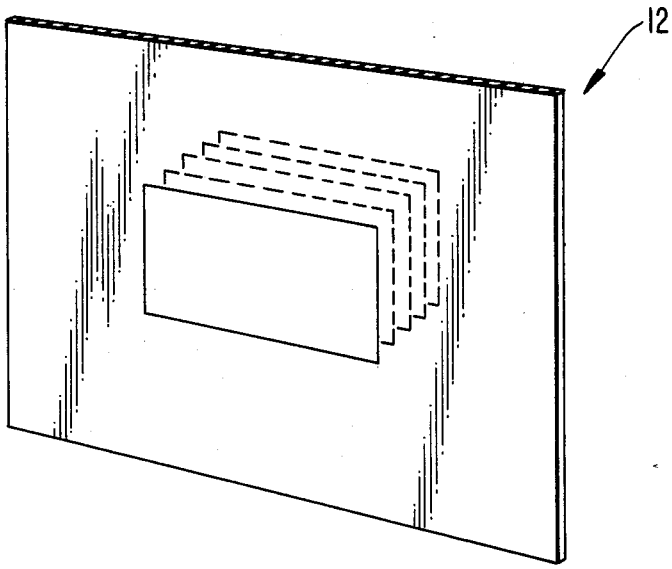

DISPLAY FOR DISPLAYING IMAGES IN THREE DIMENSIONS

This is a continuation-in-part of U.S. patent application Ser. No. 660,423 filed on Oct. 10, 1984, now abandoned.

BACKGROUND OF THE INVENTION

This invention relates to a display, in particular, to a display for displaying images in three dimensions.

U.S. Pat. No. 2,069,368 discloses such a display. The display of this U.S. Patent includes a casing having an open front and including side walls and rear wall having light-reflective inner surfaces, a light source in the casing, a front transparent mirror means consisting of a sheet of glass, a transparent light-reflective metal coating provided on the rear surface of the sheet of glass and a backing of glass sheet on the rear surface of the coating and a rear opaque mirror means provided behind the front transparent mirror means, the opaque mirror means consisting of a sheet of glass and opaque light-reflective metal coating provided on the rear surface of the glass sheet, and the opaque light-reflective coating including transparent portions in the form of a predetermined image or images. U.S. Pat. Nos. 2,114,711, 2,221,887 and 2,221,889 disclose similar displays.

However, such prior art displays are disadvantageous in that, since the displays have more than two separate glass sheets or plates, assembly of the displays is somewhat complicated and the size thereof becomes relatively large.

Further, as stated above, such displays have a mirror at the front position thereof which consists of a sheet of glass and a light-reflective coating on the rear surface of the sheet. However, from a decorative point of view, mirrorlike appearances are not desired in some kinds of displays. When the displays are used for example in the dash-boards of autos, electric calculators, electric digital clocks and so on, it is desired that the front surface of the displays looks like a metal surface or wall so as to match the appearance of the metal frame surrounding the front surface of the displays. Further, it is sometimes desired that such a metal surface or wall has a roughened or blurred appearance. U.S. Pat. No. 4,417,411 which has been assigned to the same assignee as that of this application shows displays having such appearance though those displays are not of the type where images are displayed in three dimensions.

Furthermore, if the prior art three dimensional displays stated above are put in the light when the light source provided in the displays is not turned on, there is a tendency for the light around the displays to enter the inside of the displays through transparent portions in the form of the predetermined images which are provided in the opaque light-reflective metal coating as stated above and, thus, the inside becomes visible from the outside of the displays. Such a fact is not desirable from a decorative point of view.

SUMMARY OF THE INVENTION

Accordingly, an object of the present invention is to provide a compact and simple display for displaying images in three dimensions.

Another object of this invention is to provide compact and simple three dimensional displays the front surfaces of which have the appearance of a blurred metal wall surface or a roughened metal wall surface.

A further object of this invention is to provide three dimensional displays in which the inside thereof is not easily seen from the outside even if light shines on the displays when the light source thereof is not turned on.

In accordance with this invention, the three dimensional display includes a display plate and a light source provided behind the plate. The display plate fundamentally includes a substrate made of a transparent material, an undercoating of transparent organic based color or colorless paint provided on the front surface of the plate, a light-reflective transparent metal coating on the undercoating, a transparent protective coating on the metal coating and a light-reflective means provided on the rear surface of the substrate, the light reflective means being opaque as a whole and including light-penetrable or transparent portions or vacant portions in the form of a predetermined image.

To make the front surface of the display plate look like a roughened metal wall surface, the front surface of the substrate is roughened or the undercoating contains an agent which makes the front surface of the undercoating rough.

To make the front surface of the display plate look like a blurred metal wall surface, the protective coating contains a deglazing agent. The term "deglazing agent" refers to an agent for diminishing the gloss of a metal coating.

The light reflective means provided on the rear surface of the substrate consists of a totally light-reflective or opaque light-reflective coating including vacant portions in the form of the predetermined images or consists of a transparent light-reflective coating on the rear surface of the substrate and an opaque coating containing vacant portions in the form of the predetermined image.

The rear surface of the light-reflective means provided on the rear surface of the substrate is preferably made dark in color in order to absorb the light entering the inside of the display from the outside so that it becomes difficult to see the inside even if light shines on the display under the condition of the light source provided in the display being turned off.

BRIEF EXPLANATION OF THE DRAWINGS

The foregoing and other objects, features, and advantages of the invention will be apparent from the following more clearly specified description of preferred embodiments of the invention, as illustrated in the accompanying drawings.

FIG. 1 is a schematic sectional view of a display in accordance with a first embodiment of the invention;

FIG. 3 is a perspective view of the display plate of the display shown in FIG. 1.

DETAILED DESCRIPTION OF THE PREFERRED EMBODIMENTS

Figure 2:
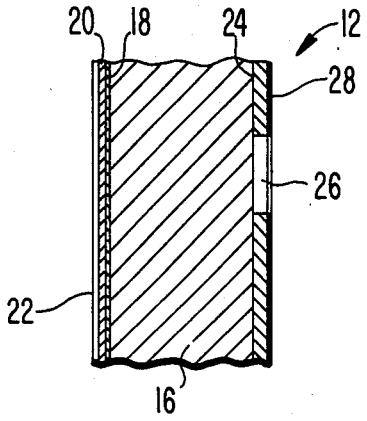
FIG. 2 is an exaggerated sectional view of a portion of the display plate of the display shown in FIG. 1.

As shown in FIG. 1, a three dimensional display in accordance with the first embodiment of this invention includes display plate 12 and a light source or electric bulb L positioned behind the display plate interposing an opalescent light scattering glass plate 14. With reference to FIG. 2, the display plate 12 includes a plate 16 made of a transparent material, an undercoating 18 of transparent organic based paint provided on the front surface of the plate, a light-reflective transparent (or light penetrable) metal coating 20 on the undercoating 18, a transparent protective coating 22 on the metal coating, the protective coating containing a deglazing agent for diminishing the gloss of a metal coating 20 and an opaque light-reflective coating 24 on the rear surface of the plate, the opaque light-reflective coating including vacant portion 26 in the form of a predetermined image. Further, in the embodiment shown, a further coating 28 is provided on the rear surface of the light reflective coating 24, the further coating made from a material of dark color so that much of the light entering into the display through the vacant portions 26 when the display has light shining on it under the condition in which the light source L is not turned on is absorbed, and thus the inside of the display cannot be easily seen in such condition.

In the preferred embodiment, the transparent organic based paint of the undercoating 18 has a predetermined color so that the three dimensional image emerging on the front surface of the display plate will be colored.

The light-reflective metal coating 20 is formed by conventional metal layer forming techniques such as vacuum deposition and sputtering. The light-reflective coating 24 is typically formed as follows: (1) the rear surface of the plate 16 is provided with desired printed marks such as printed characters and/or other indicia by silk-screen printing or another printing technique using organic paint or printing ink; (2) the totally light reflective metal coating is provided on the rear surface of the substrate by vacuum deposition or a conventional metal layer forming technique; (3) thereafter, the plate is put into the hydrocarbonic solvent and supersonic vibrations are applied to remove the printed marks and metal layer deposited on the marks so as to form vacant portions 26.

The light-reflective coating 24 can be formed by conventional methods other than that stated above. For example, it can be formed by a sputtering, plating or vacuum deposition method wherein the vacant portions 26 are formed through a masking, etching or gas laser evaporation process. Further, the coating 24 can be made by putting a metal layer including the vacant portions 26 on the rear surface of the plate 16 through, for example, a hotstamping method, or by affixing a resin sheet including an opaque light-reflective coating preformed thereon on the rear surface of the plate.

In operation, the electric bulb L is turned on. The light from the electric bulb passes only through the vacant portion 26 and the remaining light is reflected by the coating 24. The light passing through the vacant portion first strikes the transparent light-reflective metal coating 20, a part of the light passing through the metal coating 20, and the remaining light being reflected by the coating 20. The reflected light is, as shown in FIG. 1, further reflected back and forth between the light-reflective coatings 20 and 24 and part of the light passes through the coating 20 every time it strikes it. Such reflection of the light continues until the strength of the light is attenuated to a predetermined value. Accordingly, there can be seen on the front surface of the display a three dimensional image consisting of a plurality of marks, which in the embodiment shown is rectangular, each of which is formed by a portion of light which has passed through the metal coating 20. If the light source L is turned off, the three dimensional image will disappear.

Figure 4:
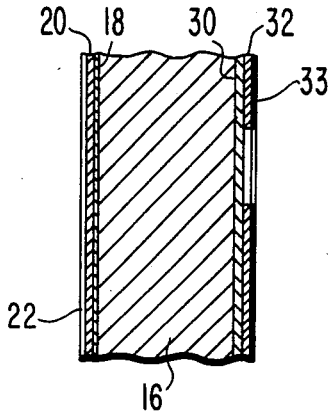
FIGS. 4–8 respectively show exaggerated sections of portions of display plates in accordance with second-sixth embodiments of the invention.

FIG. 4 shows a display plate in accordance with the second embodiment of this invention. This plate is generally similar in construction to that of the first embodiment except that, instead of the opaque light-reflecting coating 24 in the display plate of the first embodiment, the display plate of this embodiment includes a transparent light-reflective coating 30 provided on the rear surface of the plate 16 and an opaque coating 32 provided on the rear surface of the light-reflective transparent coating, a part of the opaque coating being removed in the form of a predetermined image. Though in the second embodiment, the dark color light absorbing coating 33 is provided on the rear surface of the opaque coating 30, the coating 30 itself may be made of material which is dark in color without providing light absorbing coating 33.

Figure 5:
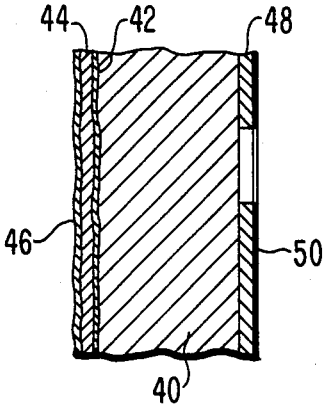

FIG. 5 discloses a display plate in accordance with the third embodiment of this invention. As shown, the display plate includes a plate 40 made of a transparent material, the front surface of which is roughened with the convex portions of the roughened surface being 25 microns or less, an undercoating 42 of transparent, organic based colored or colorless paint provided on the front surface of the plate, a light-reflective transparent metal coating 44 on the undercoating a transparent protective coating 46 on the metal coating an opaque light-reflective coating 48 provided on the rear surface of the substrate, the opaque light-reflective coating including vacant portions in the form of a predetermined image and a dark colored light absorbing coating 50 on the rear surface of the coating 48.

The front surface of the plate 40 may be roughened by a conventional surface processing method such as a scotch brushing surface processing method, a satin finish method or a graining finish method.

Figure 6:
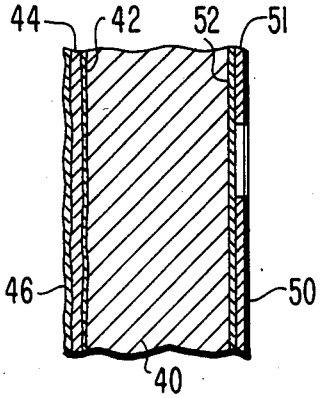

FIG. 6 shows a display plate in accordance with a fourth embodiment. This display plate is generally similar in construction to that of the third embodiment. In this display plate, the opaque light-reflective coating 48 in the third embodiment is replaced by a light-reflective transparent metal coating 52 provided on the rear surface of the glass plate 40 and an opaque coating 51 on the rear surface of the coating 52, a part of the opaque coating being removed in the form of a predetermined image. The dark colored light absorbing coating 50 is provided on the rear surface of the opaque coating 51. As stated in connection with the second embodiment, the dark colored light absorbing coating can be omitted if the opaque coating 51 is made of a dark colored material.

Figure 7:
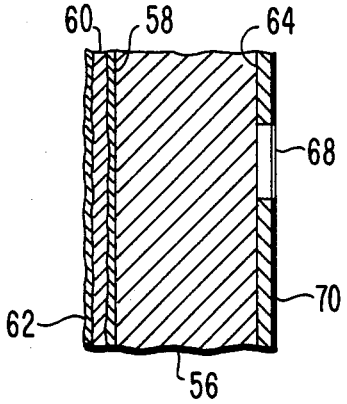

FIG. 7 discloses a display plate in accordance with the fifth embodiment. This plate includes a plate 56 made of a transparent material, an undercoating 58 of transparent organic based paint provided on the front surface of the plate 56, the paint including an agent for roughening the front surface of the undercoating, a light-reflective transparent metal coating 60 on the undercoating, a transparent protective coating 62 on the metal coating, an opaque light-reflective coating 64 on the rear surface of the plate 56, the opaque light-reflective coating including vacant portion 68 in the form of a predetermined image and a dark colored light absorbing coating 70 on the rear surface of the coating 64.

Figure 8:
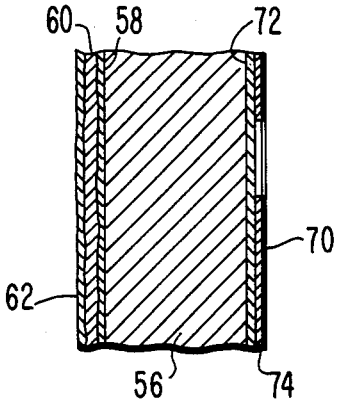

FIG. 8 discloses a display plate in accordance with a sixth embodiment. This display plate is generally similar in construction to that of the fifth embodiment except that, instead of the opaque light-reflective coating 64 of the fifth embodiment, the display plate of this embodiment includes a transparent light-reflective coating 72 provided on the rear surface of the transparent plate 56 and an opaque coating 74 on the rear surface of the light reflective coating 72. Though the dark colored light absorbing coating 70 is provided on the rear surface of the opaque coating 54, it can be replaced by an opaque coating 74 which is made of a dark colored material.

What is claimed is:

1. A display for displaying an image in three dimensions, the display including:

a plate made of a transparent material;

an undercoating of transparent organic based paint provided on the front surface of the plate;

a light-reflective transparent metal coating on said undercoating;

a transparent protective coating on said metal coating, said protective coating containing a flatting or deglazing agent;

an opaque light-reflective coating on the rear surface of the plate, said opaque light-reflective coating including a vacant portion in the form of a predetermined image; and a dark color light absorbing layer provided on the rear surface of said opaque light-reflective coating.

2. The display as set forth in claim 1 wherein said transparent organic based paint has a predetermined color.

3. A display for displaying an image in three dimensions, the display including:

a plate made of a transparent material;

an undercoating of transparent organic based paint provided on the front surface of the plate;

a light-reflective transparent metal coating on said undercoating;

a transparent protective coating on said metal coating, said protective coating containing a flatting or deglazing agent;

a light-reflective transparent coating provided on the rear surface of the plate; and an opaque coating provided on the rear surface of the light-reflective transparent coating, a part of the opaque coating being removed in the form of a predetermined image.

4. The display as set forth in claim 3 wherein said transparent organic based paint has a predetermined color.

5. The display as set forth in claim 3 wherein a dark color light absorbing layer is provided on the opaque coating, a part of the light absorbing layer being removed in alignment with said removed part in said opaque coating.

6. The display as set forth in claim 3 wherein said opaque coating is made of a dark colored material.

7. A display for displaying an image in three dimensions, the display including:

a plate made of a transparent material;

an undercoating of transparent organic based paint provided on the front surface of the plate, the paint including an agent for roughening the front surface of the undercoating;

a light-reflective transparent metal coating on the undercoating;

a transparent protective coating on said metal coating;

an opaque light-reflective coating on the rear surface of the plate, said opaque light-reflective coating including a vacant portion in the form of a predetermined image; and a dark color light absorbing layer provided on the rear surface of said opaque light-reflective coating.

8. The display as set forth in claim 7 wherein said transparent organic based paint has a predetermined color.

9. A display for displaying an image in three dimensions, the display including:

a plate made of a transparent material;

an undercoating of transparent organic based paint provided on the front surface of the plate, the paint including an agent for roughening the front surface of the undercoating;

a light-reflective transparent metal coating on the undercoating;

a transparent protective coating on said metal coating;

a light-reflective transparent coating provided on the rear surface of the plate; and an opaque coating provided on the rear surface of the light-reflective transparent coating, a part of the opaque coating being removed in the form of desired image.

10. The display as set forth in claim 9 wherein said transparent organic based paint has a predetermined color.

11. The display as set forth in claim 9 wherein a dark color light absorbing layer is provided on the opaque coating, a part of the light absorbing layer being removed in alignment with said removed part in said opaque coating.

12. The display as set forth in claim 9 wherein said opaque coating is made of a dark colored material.

13. A display for displaying an image in three dimensions, the display including:

a plate made of a transparent material, the front surface of which is roughened so as to comprise convex portions, the convex portions of the roughened front surface being 25 microns or less;

an undercoating of transparent organic based paint provided on the front surface of the plate;

a light-reflective transparent metal coating on said undercoating;

a transparent protective coating on said metal coating;

an opaque light-reflective coating provided on the rear surface of the plate, said opaque light-reflective coating including vacant portions in the form of a predetermined image; and a dark color light absorbing layer provided on the rear surface of said opaque light-reflective coating.

14. The display as set forth in claim 13 wherein said transparent organic based paint has a predetermined color.

15. A display for displaying an image in three dimensions, the display including:

a plate made of a transparent material, the front surface of which is roughened so as to comprise convex portions, the convex portions of the roughened front surface being 25 microns or less;

an undercoating of transparent organic based paint provided on the front surface of the plate;

a light-reflective transparent metal coating on said undercoating;

a transparent protective coating on said metal coating;

a light-reflective transparent coating provided on the rear surface of the plate; and an opaque coating provided on the rear surface of the light-reflective transparent coating, a part of the opaque coating being removed in the form of a desired image.

16. The display as set forth in claim 15 wherein said transparent organic based paint has a predetermined color.

17. The display as set forth in claim 15 wherein a dark color light absorbing layer is provided on the opaque coating, a part of the light absorbing layer being removed in alignment with said removed part in said opaque coating.

18. The display as set forth in claim 15 wherein said opaque coating is made of a dark colored material.

* * * * *

UNITED STATES PATENT AND TRADEMARK OFFICE

CERTIFICATE OF CORRECTION

PATENT NO. : 4,663,869

DATED : May 12, 1987

INVENTOR(S) : Shigeru NAKAGAWA

It is certified that error appears in the above-identified patent and that said Letters Patent is hereby corrected as shown below:

Under the Related U.S. Application Data in item [63], change 660,423 to --660,424--.

In the specification, Column 1, line 6, change 660,423 to --660,424--.

Signed and Sealed this

Twenty-ninth Day of December, 1987

*Attest:*

DONALD J. QUIGG

*Attesting Officer*

*Commissioner of Patents and Trademarks*